United States Patent [19]

Itami et al.

[11] 4,378,166

[45] Mar. 29, 1983

[54] PENDULUM ARRANGEMENT OF PENDULUM CLOCK

[75] Inventors: Masaru Itami; Yasue Ashibe, both of Nagano, Japan

[73] Assignee: Rhythm Watch Company, Ltd., Tokyo, Japan

[21] Appl. No.: 362,542

[22] Filed: Mar. 26, 1982

[30] Foreign Application Priority Data

Mar. 30, 1981 [JP] Japan ..... 56-45160[U]

[51] Int. Cl.[3] ..... G04B 15/00

[52] U.S. Cl. ..... 368/134; 368/165; 368/179

[58] Field of Search ..... 368/134–138, 368/165, 166, 179–183, 285

[56] References Cited

U.S. PATENT DOCUMENTS 4,139,981 2/1979 Nozawa et al. ..... 368/134
4,228,533 10/1980 Siefert ..... 368/134

FOREIGN PATENT DOCUMENTS 408725 4/1934 United Kingdom ..... 368/165
1074595 7/1967 United Kingdom ..... 368/166

*Primary Examiner*—Ulysses Weldon
*Attorney, Agent, or Firm*—Koda and Androlia

[57] ABSTRACT

In a pendulum arrangement of a pendulum clock having a pendulum arm hanging a pendulum disc on one end and being pivotally and swingingly supported at a supporting portion of a base plate, an electromagnet fixed to the base plate and a permanent magnet arranged facingly to the electromagnet and swinging together with the pendulum arm for the purpose of swinging a pendulum by means of electromagnet force of the electromagnet and the permanent magnet, a pendulum arrangement further comprising a slip arm one end of which the permanent magnet is fixed and on the other end of which is loosely engaged with the pendulum arm at a little larger slipping torque than a driving torque which said permanent magnet receives from the electromagnet, and a pair of limit pins fixed on the both side of the swinging region of the slip arm on the base plate, wherein either one of the limit pins touches the slip arm to slip the slip arm away from the pendulum arm and the permanent magnet always swings so that it can center the electromagnet.

1 Claim, 8 Drawing Figures

PENDULUM ARRANGEMENT OF PENDULUM CLOCK

BACKGROUND OF THE INVENTION

1. Field of the Invention

The present invention relates to pendulum arrangements of pendulum clocks and more particularly to a pendulum arrangement of a pendulum clock in which a magnetic urging device swings a pendulum by means of an electromagnet and a permanent magnet.

2. Description of the Prior Art

The pendulum clock is historically old and various types of pendulum clocks have been produced in such that the standard rotation for the clock operation is obtained on the basis of accurate swinging movement of pendulum. The pendulum clock in the prior art provides standard oscillation for clock operation based on the combination of a pendulum and an escapement consisted of a pallet fork and an escape wheel, but such combination of the pendulum and the escapement is recently used for a pure decoration as various types of accurate oscillating sources have been being developed. For the moving source of pendulum swing, practically used are both types of the escapement consisted of a pallet fork and an escape wheel and the magnetic urging device.

The mechanism described in the following is used as the magnetic as the magnetic urging device in the pendulum arrangements of the pendulum clocks in the prior art.

FIG. 1 is an illustration of the rear elevation of a pendulum clock which is composed of a pendulum as a pure ornamental means. A clock movement 12, a supporting shaft 14 and a pendulum driving curcuit board 16 are respectively fixed on a base plate 10 which is installed on the housing, not illustrated. The supporting shaft 14 is formed in square and arranged on the base plate 10 in such a way that an edge 14*a* is positioned at the upper end. Around the supporting shaft 14 freely arranged is a supporting pipe 18 which is cylindrically formed with larger diameter than the supporting shaft 14.

One end of a pendulum arm 20 is attached to the supporting pipe 18 mentioned above and a pendulum disc 22 is detachably hung on the other end of the pendulum arm 20. The edge 14*a* of the supporting shaft 14 acts as the fulcrum of the swinging movement of the pendulum arm 20.

In order to swing the pendulum arm 20 an electromagnet 28 including a moving coil and a steel core 26 is arranged on the pendulum driving circuit board 16, and a permanent magnet 30 is solidly attached to the pendulum arm 20 with slight air gap against the electromagnet so that the cooperative operations of the electromagnet 28 and the permanent magnet 30 can swing the pendulum arm 20.

The pendulum arrangement of the pendulum clock in the prior art is as mentioned above and supply of electric current to the moving coil 24 of the electromagnet 28 at an adequet time interval makes the permanent magnet 30 to repeat atraction and repulsion to and against the steel core 26 so that the pendulum arm 20 performs a requested swinging action as shown in FIG. 2.

Furthermore, the pendulum arrangement using the magnetic urging device of the electromagnet 28 and the permanent magnet 30 can be obtianed as a unit, and has various types of effects as well as cannot put no load on the time indicating wheel train and can use a pendulum with the large force of inertia.

In the pendulum arrangement of the pendulum clock of this kind, however, in case the clock body is tilted at $\Delta\theta$ from its vertical position as shown in FIG. 3, there is such drawbacks that the permanent magnet 30 does not face to the electromagnet in right way since the electromagnet 28 is fixed to the clock body.

In other words, the installed position of the electromagnet 28 moves from the vertical line at $\Delta\theta$, but the pendulum arm 20 always swings to the left and the right from its vertical position at $\theta$ regardless of the tilt of the clock body. Accordingly, since the swinging angle of the pendulum arm 20 to the left in FIG. 3 shows $\theta+\Delta\theta$ and the swinging angle to the right shows $\theta-\Delta\theta$, magnetic urging cannot be provided with stability.

SUMMARY OF THE INVENTION

Accordingly, it is an object of the present invention to provide a pendulum arrangement of a pendulum clock in which magnetic urging to a pendulum arm can be provided with stability in a tilted state of the clock body and the electric current consumption of the electromagnet accompanied with such state can be reduced.

In keeping with the principles of the present invention, the object of the present invention is accomplished with a pendulum arrangement of a pendulum clock having a pendulum arm hanging a pendulum disc on one end and being pivotally and swingingly supported at a supporting portion of a base plate, an electromagnet fixed to the base plate and a permanent magnet facingly arranged to the electromagnet and swinging together with the pendulum arm for the purpose of swinging a pendulum by means of electromagnet force of the electromagnet and the permanent magnet, and further comprising a slip arm on one end of which the permanent magnet is fixed and on the other end of which is loosely engaged with the pendulum arm at a little larger torque than a driving torque which the permanent magnet receives from the electromagnet, and a pair of limit pins fixed on the both sides of the swinging region of the slip arm on the base plate, wherein either one of the limit pins touch the slip arm to slip the slip arm away from the pendulum arm, and the permanent magnet always swings so that it can center the electromagnet.

BRIEF DESCRIPTION OF THE DRAWINGS

The above mentioned features and the object of the present invention will become more apparent from the following description made with reference to the accompanying drawings in which.

DETAILED DESCRIPTION OF THE DRAWINGS

Figure 1:
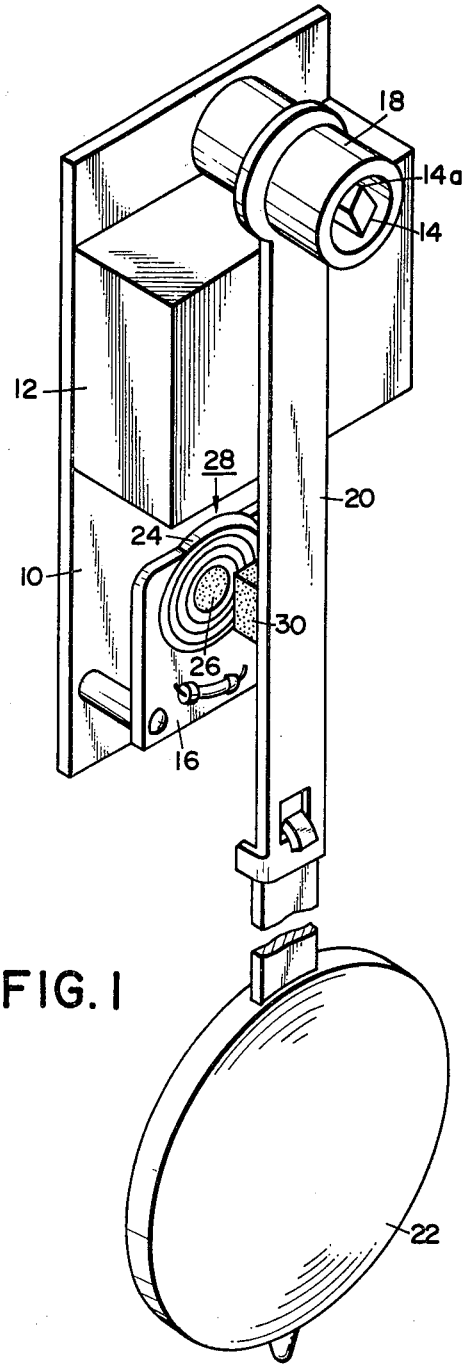
FIG. 1 is an illustration showing the rear elevation of the actual example of the pendulum arrangement of the pendulum clock in the prior art.
Figure 3:
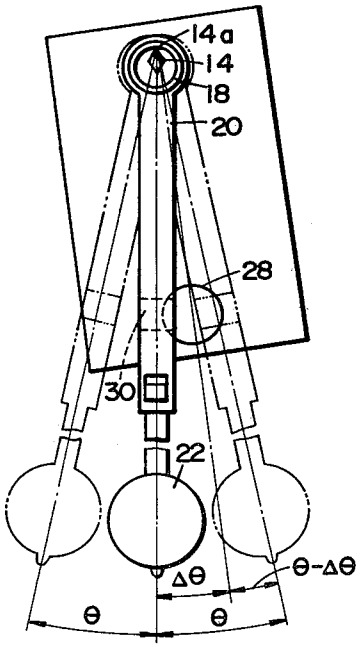
FIG. 3 is an illustration showing the swinging state of the pendulum arm in the pendulum arrangement of the clock shown in FIG. 1 when the clock body is tilted.
Figure 2:
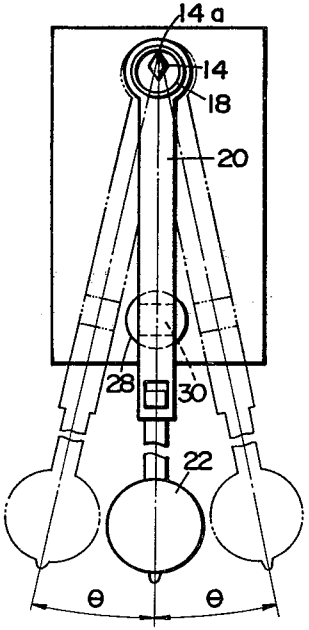
FIG. 2 is an illustration showing the swinging state of the pendulum arm in the pendulum arrangement when the clock body is not tilted.
Figure 4:
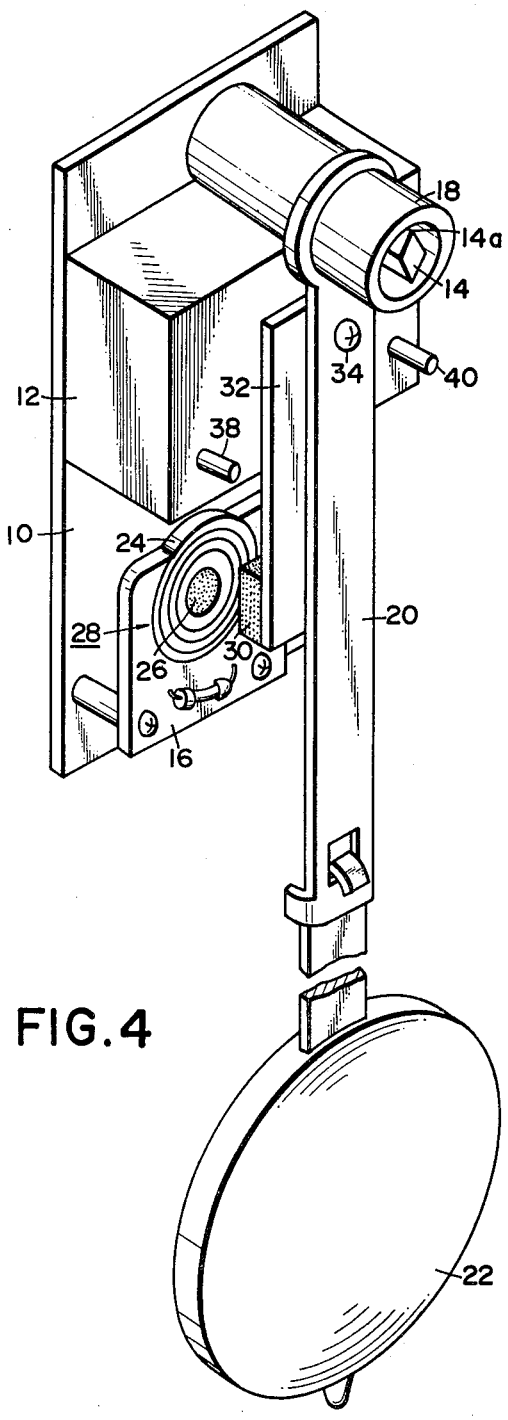
FIG. 4 is an illustration showing the rear elevation of the preferred embodiment of the pendulum arrangement of the pendulum clock in accordance with the teachings of the present invention.
Figure 5:
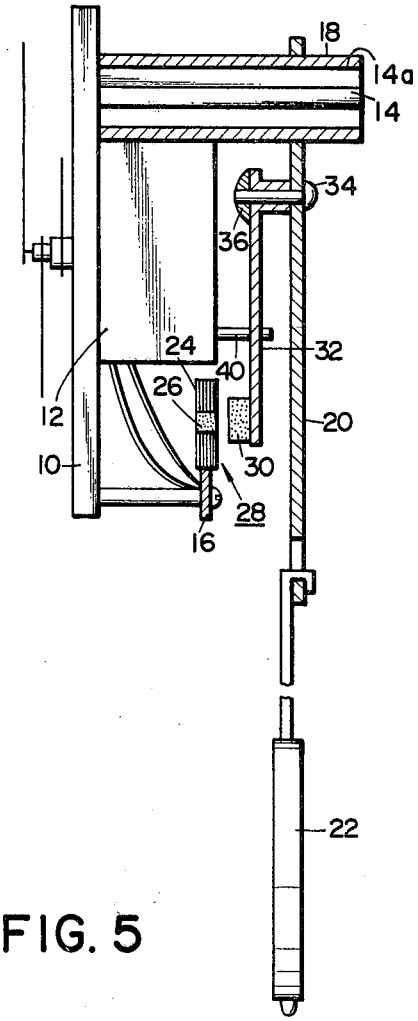
FIG. 5 is a side sectional view of the pendulum arrangement of the pendulum clock shown in FIG. 4.

FIG. 4 shows a preferred embodiment of the pendulum arrangement of the pendulum clock and FIG. 5 shows the side sectional view of FIG. 4. In both Figures the like elements in the previous Figures are denoted the like numerals and the description will be omitted.

One end of a slip arm 32 is loosely engaged with the pendulum arm 20 by a pin 34, and the permanent magnet 30 is fixed to the other end of the slip arm 32 at a slight air gap against the electromagnet 28. The slip arm 32 is loosely engaged with the pendulum arm 20 by means of a leaf spring 36 at a little larger slipping torque than a driving torque which the permanent magnet 30 receives from the electromagnet 28 so that the slip arm 32 can always swing together with the pendulum arm 20 as long as no external force is applied.

On the clock movement 12 limit pins 38 and 40 are fixed in the projected state on the both sides of the swinging region of the slip arm 32 mentioned above, and are arranged so that either one of the limit pins 38 and 40 can touch the slip arm 32 and the slip arm 32 can slip away from the pendulum arm 20.

The embodiment of the present invention is constructed as mentioned above and its operation will be described hereinafter.

Figure 6:
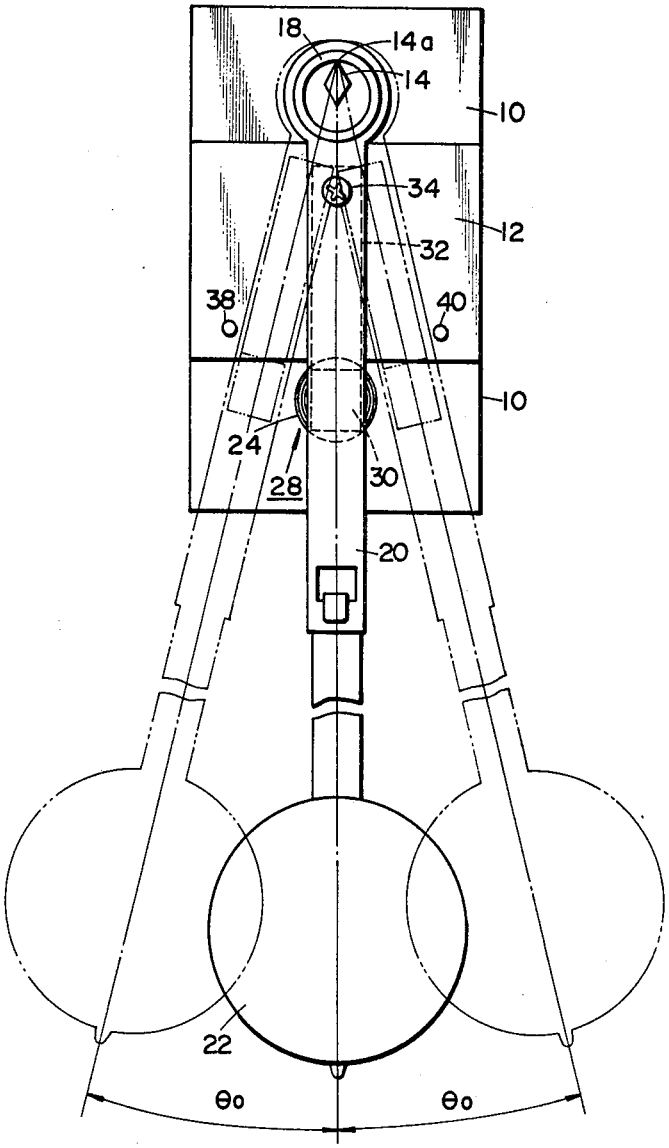
FIG. 6 is an illustration showing the swinging state of the pendulum arm in the pendulum arrangement of the pendulum clock shown in FIG. 4 when the clock body is not tilted.

FIG. 6 shows the swinging state of the pendulum arm 20 when the clock body is not tilted. The electromagnet 28 is positioned on the swinging center line of the pendulum arm 20 in this state. The slip arm 32, therefore, swings together with the pendulum arm 20 to the left and the right at $\theta_0$ without touching the limit pins 38 and 40.

Figure 7:
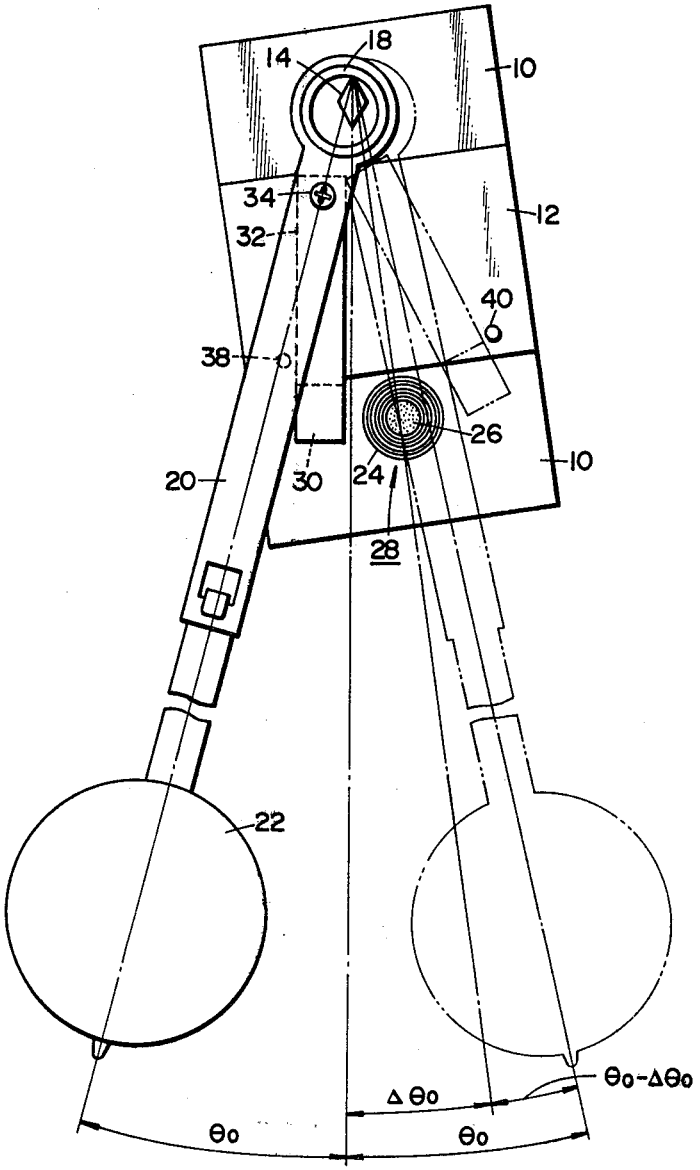
FIG. 7 is an illustration showing the swinging state of the pendulum arm in the pendulum arrangement of the pendulum clock when the clock body is tilted.

FIG. 7 shows the swinging state of the pendulum arm 20 when the clock body is tilted at $\Delta\theta_0$. The electromagnet 28 is positioned on the line shifted at $\Delta\theta_0$ from the swinging center line of the pendulum arm 20. Even if the clock body is tilted, the pendulum arm 20 swings from the vertical center line to the left and the right at $\theta_0$. At this time in FIG. 7 the limit pin 38 on the tilted side touches the slip arm 32 to slip the slip arm 32 away from the pendulum arm 20 and the slip arm 32 is placed to be held at the position rotated counter-clockwise at $\Delta\theta_0$ against the pendulum arm 20 as shown in FIG. 7.

Accordingly, the permanent magnet 28 can swing from the center line of the electromagnet 28 to the left and the right at $\theta_0$, and magnetic urging can be performed to the pendulum arm 20 with stability when the clock body is tilted.

Figure 8:
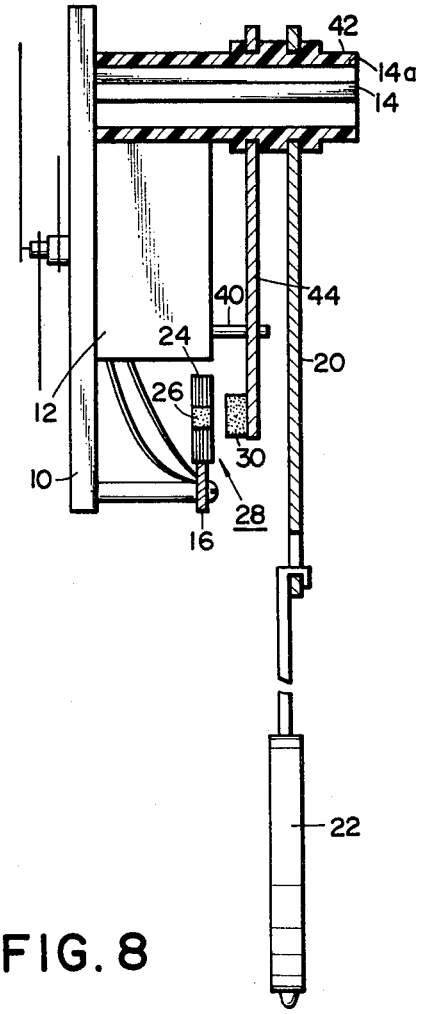
FIG. 8 is a side sectional view showing another preferred embodiment of the pendulum arrangement of the pendulum clock in accordance with the teachings of the present invention.

FIG. 8 shows another preferred embodiment of the pendulum clock in accordance with the teachings of the present invention. In Figure the like elements described in the previous embodiment are denoted the like numerals and the description will be omitted.

One end of a slip arm 44 is loosely engaged with a supporting pipe 42 and the permanent magnet 30 is fixed on the other end of the slip arm 44 at a slight air gap against the electromagnet 28. As for the means for loosely engaging the above mentioned slip arm 44 with the supporting pipe 42 an insert forming is preferable, for example.

The insert forming is performed in such a way that one end of the slip arm 44 made of metal is placed and fixed in the mold which is previously formed into the shape of the supporting pipe 42 and molten plastic is poured into the mold. The difference of thermal expansion between the slip arm 44 of metal and the supporting pipe 42 of plastic can loosely engage the slip arm 44 with the supporting pipe 42 at a little larger slipping torque than the driving torque which the permanent magnet 30 receives from the electromagnet 28 in the same way with the embodiment described above.

Also in the same way with the embodiment mentioned above either one of the limit pins 38 and 40 touches the slip arm 44 to slip the slip arm 44 away from the pendulum arm 20, and the slip arm 44 is placed to be held at the position rotated at a tilted angle of the clock body.

Accordingly, as described in the previous embodiment magnetic urging can be performed to the pendulum arm 20 with stability when the clock body is tilted.

As described heretofore, according to the present invention, since the slip arm is loosely engaged with the pendulum arm at a little larger slipping torque than the driving torque which receives from the electromagnet and either one of a pair of the limit pins fixed on both side of the swinging region of the slipping arm touches the slip arm to slip the slip arm away from the pendulum arm, the permanent magnet always swings so that it centers the electromagnet and magnetic urging can be performed to the pendulum arm with stability.

Consequently, the efficiency of the electromagnet can be increased and the electric currency can also be reduced.

What we claim is:

1. In a pendulum arrangement of a pendulum clock having a pendulum arm hanging a pendulum disc on one end and being pivotally and swingingly supported at a supporting portion of a base plate, an electromagnet fixed to the base plate and a permanent magnet arranged facingly to the electromagnet and swinging together with the pendulum arm for the purpose of swinging a pendulum by means of electromagnet force of the electromagnet and the permanent magnet, a pendulum arrangement further comprising:

a slip arm on one end of which the permanent magnet is fixed and on the other end of which is loosely engaged with the pendulum arm at a little larger slipping torque than a driving torque which said permanent magnet receives from said electromagnet; and a pair of limit pins fixed on the both side of the swinging region of said slip arm on the base plate;

wherein either one of the limit pins touches said slip arm to slip said slip arm away from the pendulum arm and the permanent magnet always swings so that it can center the electromagnet.

* * * * *